United States Patent [19]

Leonard

[11] 4,412,486

[45] Nov. 1, 1983

[54] PRESS CONSTRUCTION

[76] Inventor: Frank W. Leonard, P.O. Box 5634, Boise, Id. 83705

[21] Appl. No.: 298,075

[22] Filed: Aug. 31, 1981

[51] Int. Cl.[3] ..... B30B 15/06

[52] U.S. Cl. ..... 100/229 R; 100/269 A; 100/295; 100/913

[58] Field of Search ..... 100/229 R, 269 A, 258 A, 100/214, 295, 913

[56] References Cited

U.S. PATENT DOCUMENTS

| | | | |
|---|---|---|---|
| 1,698,613 | 1/1929 | Van Duzer | 100/229 R |
| 2,243,205 | 5/1941 | Hall | 100/258 A |
| 3,135,998 | 6/1964 | Fowler | 100/269 A |
| 4,351,233 | 9/1982 | Leonard | 100/269 A X |

FOREIGN PATENT DOCUMENTS

| | | | |
|---|---|---|---|
| 2289409 | 5/1976 | France | 100/269 A |

*Primary Examiner*—Billy J. Wilhite

*Attorney, Agent, or Firm*—Eugene M. Eckelman

[57] ABSTRACT

A first platen is associated with lift means for raising it into pressing engagement with a second platen. The second platen is movable on a support frame for the press between an advanced pressing position in overlapping relation with the first platen and a retracted position for loading and unloading articles onto the first platen. The second platen has wheeled support on an upper portion of the press frame to provide free interior space for the mounting of press operating and control elements. The press has a top opening for loading articles onto the first platen and for removing such articles. A hood is employed having a front opening for receiving and concealing the second platen in its retracted position. This hood has adjustable support on the press frame whereby it can be secured in a rearward position for accommodating retracted movement of the second platen or for securing it in a forward position for compacting the press for shipment. Air cushion cylinders are provided between the hood and the upper platen for bringing the latter to a stop without impact. The front wall of the hood is capable of supporting holders for connectors or other parts which may be used in the operation of the press.

6 Claims, 6 Drawing Figures

FIG. 1
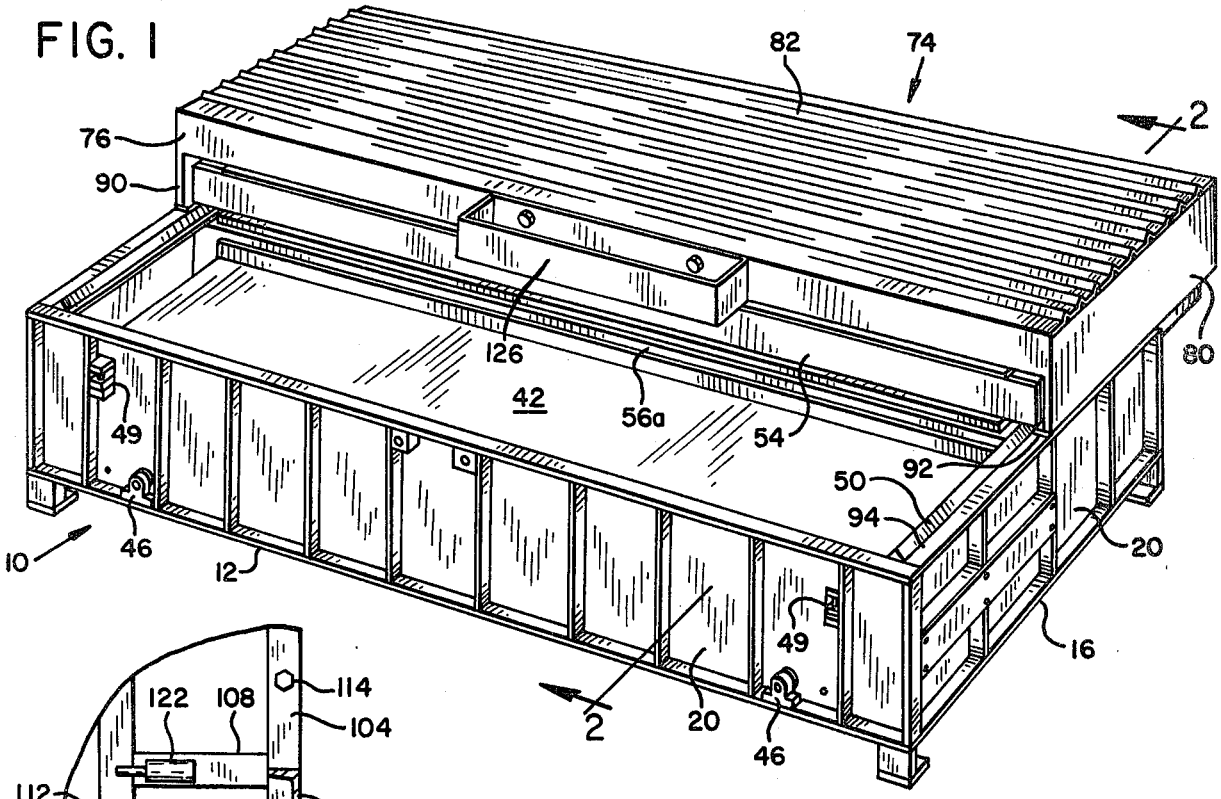
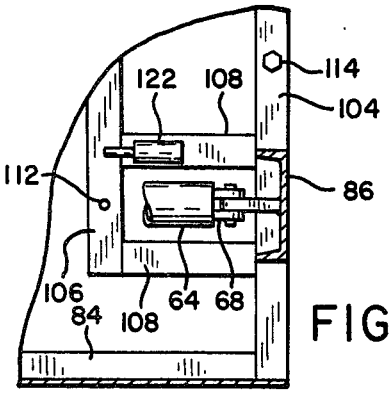
FIG. 6
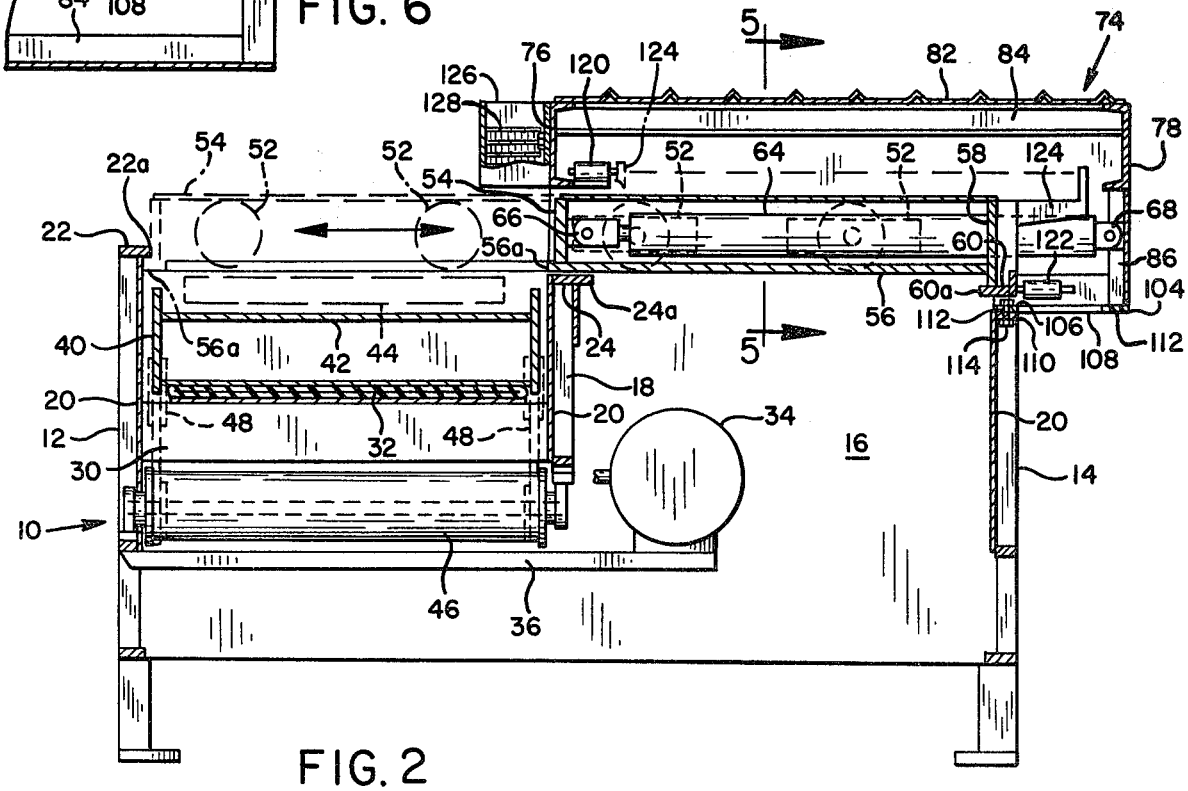
FIG. 2

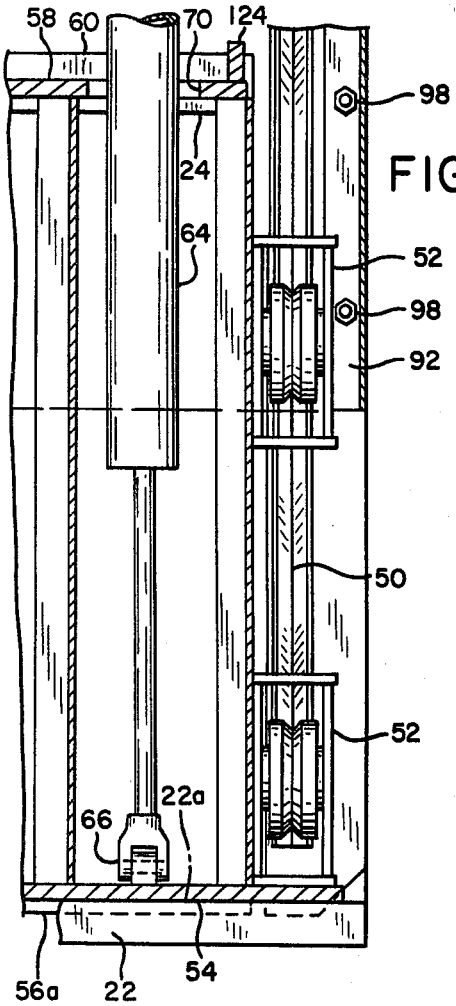
FIG. 4
FIG. 5
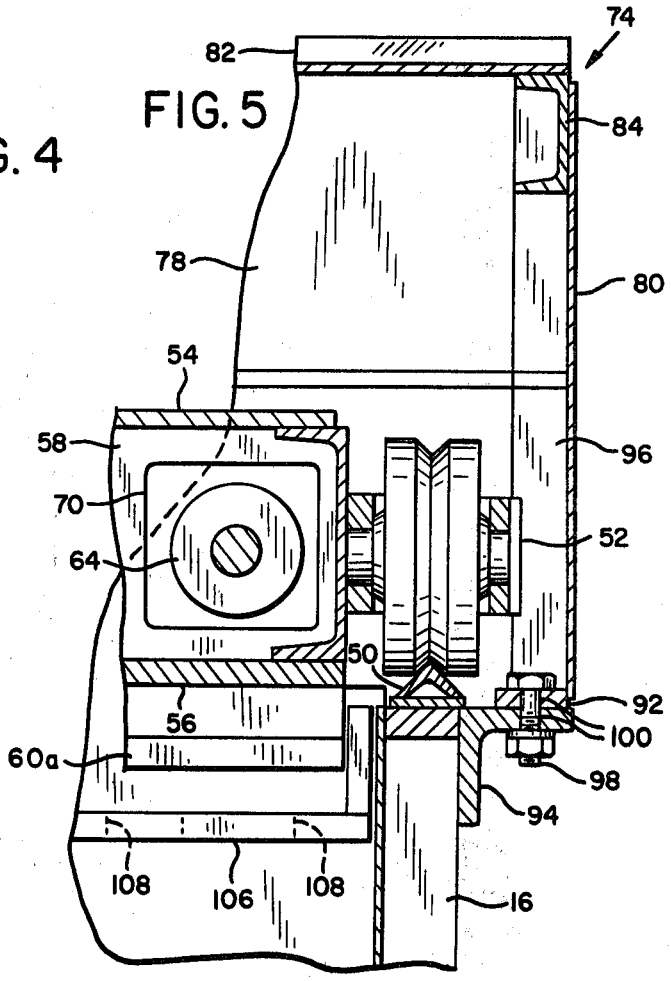
FIG. 3
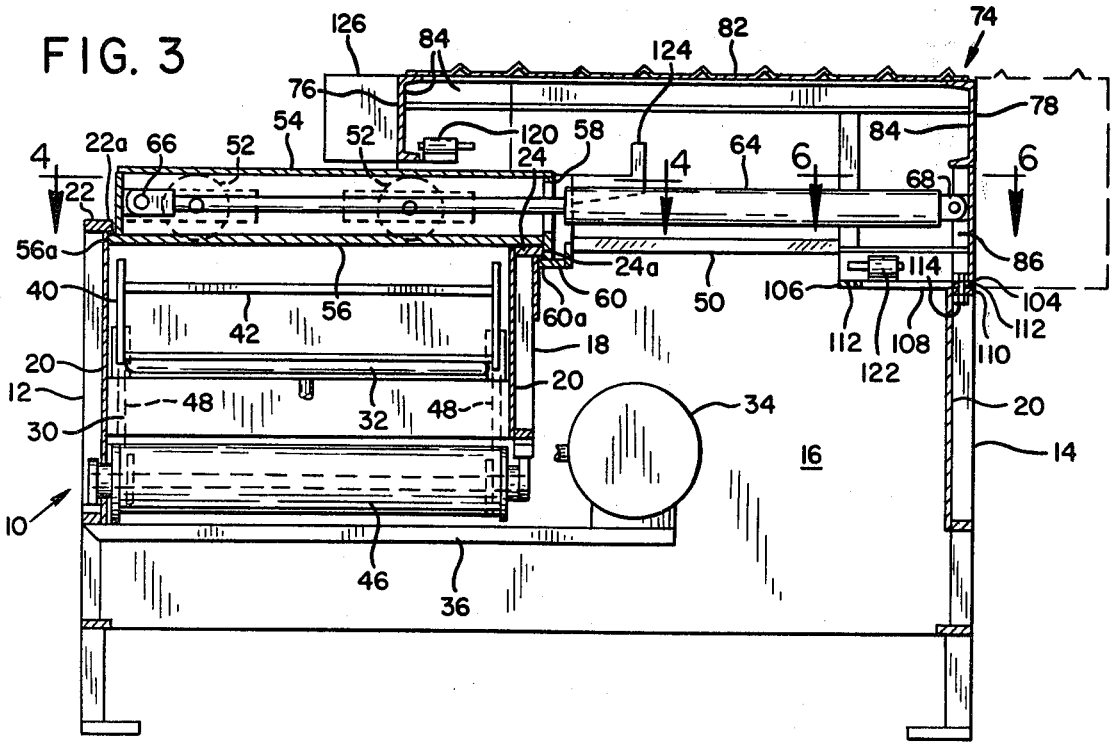

PRESS CONSTRUCTION

FIELD OF THE INVENTION

This invention relates to new and useful improvements in press constructions and is particularly concerned with a press structure of the type that is opened and closed for each pressing operation.

SUMMARY OF THE INVENTION

A primary objective of the present invention is to provide a press construction employing a first platen having vertical pressing movement against an upper second platen, the second platen having wheeled support on an upper portion of the press and being movable by power means between an advanced pressing position and a retracted position, such arrangement providing an efficient operation of the second platen and also providing a maximum of housing space within the press frame for mounting press operating elements and control means.

Another object is to provide a press construction having a top hood for receiving and concealing a horizontally movable platen in a retracted position, such press including releasable means securing said hood either in a rearwardly disposed position for use of the press in pressing operations or for securing said hood in a forward position for compacting the press for shipment.

Still another object of the invention is to provide a press having a top hood and horizontally movable second platen of the type described and power means connected between the second platen and the hood for moving such platen between a forward pressing position and a retracted position. Other objects are to provide air cushion cylinders between the hood and the upper platen for bringing the latter to a stop without impact, and to provide front support means on the hood capable of holding connectors or other parts in a convenient place of access for the press operator.

In carrying out the objectives of the invention, a press employs a first platen associated with lift means arranged to move such platen upwardly to a pressing position. Second platen means are employed to form an abutment for articles being compressed upon operation of the first platen means. The second platen means is movable horizontally on wheeled support means on an upper portion of the press. A hood is employed at the upper portion of the frame and has a front opening for receiving and concealing the second platen means in the retracted position of the latter. Power drive means for moving the second platen means are connected between such platen means and the hood. The press has top frame portions extending from front to rear and across the rear and the hood has engaging frame portions for securing it in place. The secured engaging means between the frame and the hood are releasable and arranged such that the hood can be secured either in a rearwardly disposed position for accommodating the second platen or it can be secured in a forward position for compacting the press for shipment. Air cushion cylinders are mounted between the hood and the upper platen to provide the cushioned stop. The front wall of the hood is capable of supporting holders for connectors or other parts used for the formation of products by the press.

The invention will be better understood and additional objects and advantages will become apparent from the following description taken in connection with the accompanying drawings.

BRIEF DESCRIPTION OF THE DRAWINGS

FIG. 1 is a perspective view of a press embodying features of the present invention;

FIG. 2 is an enlarged cross sectional view taken on the line 2—2 of FIG. 1, this view showing an operative condition of the press with the second platen being shown in full lines in a retracted position for loading of the press and being shown in broken lines in a forward pressing position;

FIG. 3 is a view taken similar to FIG. 2 but showing a compacted condition of the press for shipment;

FIG. 4 is an enlarged fragmentary horizontal sectional view taken on the line 4—4 of FIG. 3, this view being turned 90 degrees counterclockwise from the sectional position of line 4—4;

FIG. 5 is an enlarged vertical, fragmentary sectional view taken on the line 5—5 of FIG. 2; and FIG. 6 is a fragmentary sectional view taken on the line 6—6 of FIG. 3.

DETAILED DESCRIPTION OF A PREFERRED EMBODIMENT

With particular reference to the drawings, the press of the invention comprises a base frame 10 in the form of a housing having open top and bottom ends. This base frame is defined by reinforced walls comprising a front wall 12, a rear wall 14, and side walls 16. An interior wall 18 of reinforced construction extends from side to side of the base frame. The wall portions 12, 14, 16 and 18 have a covering or skin 20 as necessary to enclose the inner area of the press. As best seen in FIGS. 2 and 3, front wall 12 has a top plate 22 extending the full length thereof. This top plate has a rearward portion **22*a* projecting beyond the rear surface of front wall 12. Similarly, intermediate wall 18 has a top plate 24, and this top plate has a rear portion 24*a* projecting beyond the rear surface of wall 18. The purpose of projecting plate portions 22*a* and 24*a*** will become apparent hereinafter.

A base member 30, FIGS. 2 and 3, is secured integrally between the front wall 12 and the intermediate wall 18 and serves as a support for an air bag 32 associated with an air tank 34 supported on a base 36 integral with the frame 10. Suitable control means, not shown, are provided for operation of the air bag. A lower or first platen 40 is supported on the air bag 32 and has a top plate 42 forming a base surface for articles 44, FIG. 2, to be pressed. Platen 40 is stabilized by a torque tube means 46 connected thereto by links 48 and is also guided vertically by guide means 49, FIG. 1. Such vertically stabilizing structure may take any suitable form as long as it maintains upward travel of the platen 48 and does not allow any appreciable lateral or front-to-rear play.

Base frame 10 has tracks 50, FIGS. 1, 4 and 5, extending along the top of side walls 16. The tracks support wheel assemblies 52, also seen in FIGS. 2 and 3, secured on the side edges of a top or second platen 54 having a bottom plate 56 serving as an abutting or upper surface in a pressing operation of lower plate 40. Bottom plate 56 of the platen 54 has a front projection **56*a* arranged in a forward position of the platen, FIG. 3, to hook under projection 22*a* of top plate 22. Also, the rearward end of platen 54 has a wall 58 which depends below the bottom plate 56 and which supports a horizontal wall segment 60 with a forward projecting end 60***a* arranged to hook under the projecting edge 24*a* of top plate 24 of the wall 18. By means of the hooked engagement of projections 56*a* and 60*a* with wall portions 22*a* and 24*a*, respectively, the upper platen 54 is firmly anchored against upward pressing movement of the platen 40 resulting from operation of the air bag 32. The upper platen is thus firmly anchored in place by means of projections 56*a* and 60*a*. The lower platen is securely stabilized in its movement by the vertical stabilizing means 49 whereby in such cooperation of the two platens, efficient setting of prongs and other fasteners can be accomplished without bending.

Platen 54 is operated between a forward pressing position and a rearward retracted position by a fluid operated cylinder 64 having an attachment 66 at one end with the platen 54 and an attachment 68 at its other end with a portion of the press, to be described. The cylinder 64 is horizontal and extends through an opening 70, FIG. 5, in the rear wall 58 of the platen 54.

The press employs a hood 74 disposed at the rearward portion thereof for covering the rear of the frame and also concealing the upper platen 54 in its retracted movement. The hood includes a front wall 76, FIGS. 1, 2 and 3, a rear wall 78, side walls 80, and a top wall 82. The hood has suitable reinforcing members 84 around its edges as necessary, and in addition the rear wall 78 has a vertical reinforcing member 86, FIGS. 2, 3 and 6, providing a reinforced securement for the rear end attachment 68 of the fluid operated cylinder 64. The front wall 76 has an opening 90 which opens through the bottom of such wall for receiving the platen 54.

With particular reference to FIG. 2, it will be noted that a rearward portion of the hood 74 projects beyond the rear of the base frame 10. Such projecting portion is for the purpose of accommodating operation of the upper platen 54 and cylinder 64. This extra projection of the hood adds dimension of the overall press from front to rear and has the disadvantage that the press has excess bulkiness in shipment and storage. To overcome this disadvantage, provision is made for moving the hood forward and securing it in place with the rearward portion thereof flush with the rearward portion of the base frame, thus compacting the size of the press from front to rear. The forward compacted position of the hood is shown in FIG. 3. For this compacting purpose, the side walls 80 of the hood 74 have bottom front to rear frame members 92, FIGS. 1, 4 and 5 seated on angle brackets 94 integral with the side walls 16 of the base frame 10. Frame members 92 have integral securement to the hood 74 by upright reinforcing members 96 and are releasably secured to brackets 94 by bolts 98 engageable in aligned holes 100 in the plates 92 and brackets 94.

To make clearance for rearward travel of the upper platen 54 and other structure, to be described, and also to assist in support of the hood in its operating position, as well as a forward compacted position thereof, the hood has a rear support portion which is disposed below the bottom edge thereof. This support portion includes a rear transverse frame member 104, FIGS. 2 and 3, integrated with upright reinforcing members 86 and 96 and a forwardly spaced transverse frame member 106, also seen in FIG. 6, secured to the frame member 104 by connecting frame members 108. Rear wall 20 of the base frame has a top support bar 110 disposed at a height to provide support engagement by one or the other of the depending transverse frame members 104 or 106.

Each of the transverse frame members 104 and 106 has a plurality of bolt holes 112, FIGS. 2, 3 and 6, arranged to receive bolts 14 for securing the rear portion of the hood to the base frame. Holes 112 in each of the frame members 104 and 106 are selectively aligned with matching holes in the support bar 110 whereby the hood can be bolted to the support bar 110 by means of transverse frame member 106 in its rearward operating condition as seen in FIG. 2, or the hood can be bolted to the support bar 110 by means of transverse frame member 104 in its compacted condition as shown in full lines in FIG. 3.

In order to provide an adjustable connection at the sides of the hood to allow for the compacting movement, the holes 100 are selectively spaced such that pairs thereof in the members 92 and 94 will be aligned to receive bolts 114 in both positions of the hood. The upper platen 54 is moved to a forward position in the compacted condition of the press, such as to a full forward position as shown in FIG. 3, and held in this position by any suitable means, as by blocking the wheels.

Upper platen 54 is of heavy construction to withstand the pressing forces, and in order to provide a cushioned stop at its limits of travel, air cushion cylinders 120 and 122 are mounted on forward and rearward portions, respectively, of the hood. Cylinder 120 is secured integrally to front wall 76 and is engageable by an arm 124 on the upper platen near the end of forward travel of the latter. Cylinder 122 is secured to the rear depending portion of the hood such as to one of the frame members 108, and is engageable by a rear portion wall 60 near the end of rearward travel of the platen.

By means of the particular press construction using the adjustable hood, such press can be compacted for shipment. Also, by means of the specific construction of the hood and the upper mounted support of the upper platen, the inner area of the press behind the lower platen assembly comprises a free area in which operating elements and controls therefor can be housed.

The front wall 76 of the press is capable of supporting one or more holders 126 such as boxes as shown, or shelves, brackets, etc. for holding a supply of connectors 128 or other supplies used in the pressing operation.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A press construction comprising:

(a) support means including an upright frame having front, rear and side portions as well as top and bottom portions, (b) first platen means, (c) said first platen means having a pressing surface for supporting articles in the press and being movable upwardly in a pressing position and downwardly in a retracted position, (d) lift means between said support means and said first platen means arranged to move said first platen means upwardly to a presssing position, (e) second platen means having a longitudinal pressing surface facing the pressing surface of said first platen means to form an abutment for articles being compressed upon operation of said lift means, (f) movable support means on said frame and second platen means extending from front to rear,
(g) said movable support means being disposed adjacent an upper portion of said frame,
(h) said second platen means being movable on said movable support means relative to said first platen means in a plane parallel with said pressing surfaces to move between an advanced pressing position in overlapping relation with said first platen means for pressing articles by operation of said lift means and a retracted position for loading and unloading articles onto said first platen means,
(i) an opening in said frame above said first platen means for loading articles onto said first platen means and removing them,
(j) said second platen means in its advanced pressing position spanning said opening and closing the same,
(k) a hood supported on said frame,
(l) said hood having a front opening for receiving and concealing said second platen means in its retracted position,
(m) said hood having a rear extension projecting beyond the rear portion of said frame to accommodate said second platen means in said retracted position,
(n) and releasable means securing said hood either in its rearwardly extending position for use of the press in pressing operations or for securing said hood in a forward position for compacting the press for shipment.

2. A press construction comprising:
(a) support means including an upright frame having front, rear and side portions as well as top and bottom portions,
(b) first platen means,
(c) said first platen means having a pressing surface for supporting articles in the press and being movable upwardly in a pressing position and downwardly in a retracted position,
(d) lift means between said support means and said first platen means arranged to move said first platen means upwardly to a pressing position,
(e) second platen means having a longitudinal pressing surface facing the pressing surface of said first platen means to form an abutment for articles being compressed upon operation of said lift means,
(f) movable support means on said frame and second platen means extending from front to rear,
(g) said second platen means being movable on said movable support means relative to said first platen means in a plane parallel with said pressing surface to move between an advanced pressing position in overlapping relation with said first platen means for pressing articles by operation of said lift means and a retracted position for loading and unloading articles onto said first platen means,
(h) a hood supported on said frame,
(i) said hood having a front opening for receiving and concealing said second platen means in its retracted position,
(j) said hood having a rear extension projecting beyond the rear portion of said frame to accommodate said second platen means in said retracted position,
(k) and releasable means securing said hood either in its rearwardly extending position for use of the press in pressing operations or for securing said hood in a forward position for compacting the press for shipment.

3. The press construction of claim 2 wherein said frame includes top frame portions extending from front to rear on each side on which said hood is supported, and bolt connection means on said top frame portions and said hood for securing said hood in either its rearward or forward positions.

4. The press construction of claim 3 wherein said hood has a rear downward extension to accommodate a portion of said second platen means, said top frame portions including a rear portion extending from side to side in a plane lower than said side support portions for releasable connection to said downward extension of said hood in the rearward and retracting positions thereof.

5. The press construction of claim 2 wherein said hood has a front wall in which said front opening is provided, and means on said front wall arranged to support assembly parts for the formation of products by the press.

6. A press construction comprising:
(a) support means including an upright frame having front, rear and side portions as well as top and bottom portions,
(b) first platen means,
(c) said first platen means having a pressing surface for supporting articles in the press and being movable upwardly in a pressing position and downwardly in a retracted position,
(d) lift means between said support means and said first platen means arranged to move said first platen means upwardly to a pressing position,
(e) second platen means having a longitudinal pressing surface facing the pressing surface of said first platen means to form an abutment for articles being compressed upon operation of said lift means,
(f) movable support means on said frame and second platen means extending from front to rear,
(g) said movable support means being disposed adjacent an upper portion of said frame,
(h) said second platen means being movable on said movable support means relative to said first platen means in a plane parallel with said pressing surfaces to move between an advanced pressing position in overlapping relation with said first platen means for pressing articles by operation of said lift means and a retracted position for loading and unloading articles onto said first platen means,
(i) an opening in said frame above said first platen means for loading articles onto said first platen means and removing them,
(j) said second platen means in its advanced pressing position spanning said opening and closing the same,
(k) a hood supported on said frame,
(l) said hood having a front opening for receiving and concealing said second platen means in its retracted position,
(m) and fluid operated cylinder means connected between said second platen means and said hood providing said movement of said second platen means.

* * * * *